US008958737B2

(12) United States Patent
Karasawa et al.

(10) Patent No.: US 8,958,737 B2
(45) Date of Patent: Feb. 17, 2015

(54) LUBRICANT SUPPLYING DEVICE, PROCESS CARTRIDGE, AND IMAGE FORMING APPARATUS

(75) Inventors: Shinya Karasawa, Kanagawa (JP); Ken Amemiya, Toyko (JP); Michiya Okamoto, Kanagawa (JP); Takuma Iwasaki, Kanagawa (JP); Yuta Azeyanagi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 398 days.

(21) Appl. No.: 13/349,054

(22) Filed: Jan. 12, 2012

(65) Prior Publication Data

US 2012/0195661 A1 Aug. 2, 2012

(30) Foreign Application Priority Data

Jan. 27, 2011 (JP) ..... 2011-014799

(51) Int. Cl.
*G03G 21/00* (2006.01)

(52) U.S. Cl.
CPC ..... *G03G 21/0094* (2013.01)
USPC ..... 399/346

(58) Field of Classification Search
USPC ..... 399/346
See application file for complete search history.

(56) References Cited

U.S. PATENT DOCUMENTS 4,463,774 A * 8/1984 Gorges et al. ..... 137/81.1
4,538,563 A * 9/1985 Mayers ..... 123/90.67
4,586,843 A * 5/1986 Heng et al. ..... 403/252
5,246,215 A * 9/1993 Takamura et al. ..... 267/170
5,397,244 A * 3/1995 Generoli et al. ..... 439/248
5,893,007 A 4/1999 Lim
7,305,203 B2 * 12/2007 Sampe et al. ..... 399/111
7,333,744 B2 * 2/2008 Shimojo et al. ..... 399/71
7,373,101 B2 * 5/2008 Hozumi et al. ..... 399/346
7,583,925 B2 9/2009 Karasawa
7,672,635 B2 * 3/2010 Hozumi et al. ..... 399/346
7,832,422 B2 * 11/2010 Endoh et al. ..... 137/540
7,899,382 B2 * 3/2011 Hozumi et al. ..... 399/346
7,941,071 B2 * 5/2011 Fujimori ..... 399/102
7,953,362 B2 5/2011 Arai et al.

(Continued)

FOREIGN PATENT DOCUMENTS

CN 101030072 A 9/2007
JP 06-235781 8/1994

(Continued)

OTHER PUBLICATIONS

Machine translation of JP 2009015033 A.*

(Continued)

*Primary Examiner* — David Bolduc
(74) *Attorney, Agent, or Firm* — Harness, Dickey & Pierce P.L.C.

(57) ABSTRACT

A lubricant supplying device includes a compressing spring that has one end coming into contact with a holding member in order to bias a solid lubricant toward a lubricant supplying roller and a casing that covers the outside of the device. Then, the casing includes an opening portion that allows the other end of the compressing spring, having the one end coming into contact with the holding member, to be exposed therethrough, and the casing further includes a cover member that is installed in the opening portion in a removable manner so that the cover member comes into contact with the other end of the compressing spring.

12 Claims, 5 Drawing Sheets

(56) References Cited

U.S. PATENT DOCUMENTS

| | | | | |
|---|---|---|---|---|
| 7,953,363 | B2 | 5/2011 | Honjoh et al. | |
| 8,041,280 | B2 | 10/2011 | Koike et al. | |
| 8,052,129 | B2 * | 11/2011 | Youd et al. | 267/179 |
| 8,655,254 | B2 | 2/2014 | Arai et al. | |
| 2005/0271420 | A1 * | 12/2005 | Arai et al. | 399/176 |
| 2006/0115286 | A1 * | 6/2006 | Uchitani et al. | 399/50 |
| 2006/0285897 | A1 | 12/2006 | Sugiura et al. | |
| 2007/0059067 | A1 * | 3/2007 | Tanaka et al. | 399/346 |
| 2007/0068738 | A1 * | 3/2007 | Kawahara et al. | 184/99 |
| 2007/0183824 | A1 * | 8/2007 | Suda et al. | 399/346 |
| 2007/0209877 | A1 * | 9/2007 | Arai et al. | 184/3.2 |
| 2008/0118285 | A1 | 5/2008 | Karasawa | |
| 2008/0175635 | A1 | 7/2008 | Hozumi et al. | |
| 2009/0060600 | A1 * | 3/2009 | Ninomiya et al. | 399/346 |
| 2009/0120356 | A1 | 5/2009 | Karasawa et al. | |
| 2009/0241830 | A1 | 10/2009 | Koike et al. | |
| 2010/0021205 | A1 | 1/2010 | Honjoh et al. | |
| 2010/0239309 | A1 * | 9/2010 | Tanaka et al. | 399/111 |
| 2010/0310291 | A1 * | 12/2010 | Tanaka et al. | 399/346 |
| 2010/0316422 | A1 * | 12/2010 | Amemiya et al. | 399/346 |
| 2011/0052286 | A1 * | 3/2011 | Urayama et al. | 399/346 |
| 2011/0076075 | A1 * | 3/2011 | Arai et al. | 399/346 |
| 2011/0123239 | A1 | 5/2011 | Azeyanagi et al. | |
| 2011/0217101 | A1 | 9/2011 | Okamoto et al. | |
| 2011/0229232 | A1 * | 9/2011 | Kojima et al. | 399/346 |

FOREIGN PATENT DOCUMENTS

| | | | |
|---|---|---|---|
| JP | 2001305907 | A | 11/2001 |
| JP | 2002-323802 | A | 11/2002 |
| JP | 2009-015033 | A | 1/2009 |
| JP | 2009008819 | A | 1/2009 |
| JP | 2009015033 | A * | 1/2009 |
| JP | 2010-107967 | A | 5/2010 |
| JP | 2010107967 | A | 5/2010 |
| JP | 2010-217304 | A | 9/2010 |
| JP | 4742240 | B2 | 5/2011 |

OTHER PUBLICATIONS

Machine translation of JP 2010217304 A.*
English language abstract of JP 2006201565.
Chinese Office Action and English translation thereof dated Dec. 30, 2013.
Office Action dated Sep. 17, 2014 for corresponding Japanese patent application No. 2011-014799.

* cited by examiner

LUBRICANT SUPPLYING DEVICE, PROCESS CARTRIDGE, AND IMAGE FORMING APPARATUS

CROSS-REFERENCE TO RELATED APPLICATIONS

The present application claims priority to and incorporates by reference the entire contents of Japanese Patent Application No. 2011-014799 filed in Japan on Jan. 27, 2011.

BACKGROUND OF THE INVENTION

1. Field of the Invention

The present invention relates to an electro-photographic image forming apparatus such as a copying machine, a printer, a facsimile, or a multi-functional peripheral thereof, to a lubricant supplying device installed therein, and also to a process cartridge.

2. Description of the Related Art

Hitherto, in an image forming apparatus such as a copying machine or a printer, there is a known technique using a lubricant supplying device which supplies a lubricant to an image carrier such as a photosensitive drum or an intermediate transfer belt (for example, see Japanese Patent Application Laid-open No. 2006-201565 and Japanese Patent Application Laid-open No. 2001-305907).

Specifically, non-transferred toner which remains on a photosensitive drum after a transfer process needs to be completely removed by a cleaning blade (a cleaning device) which comes into contact with the photosensitive drum. However, in a case in which a contact portion of the cleaning blade is chipped (damaged) due to the friction against the photosensitive drum, the non-transferred toner goes through a gap between the damaged cleaning blade and the photosensitive drum, which results in a cleaning defect.

In order to solve this problem, a method may be considered in which a lubricant is coated onto the photosensitive drum so as to reduce a friction coefficient on the photosensitive drum. This method reduces the abrasion and the damage of the cleaning blade or the deterioration of the photosensitive drum, and as a result, the cleaning defect with an elapse of time may be suppressed.

Specifically, in Japanese Patent Application Laid-open No. 2006-201565 and Japanese Patent Application Laid-open No. 2001-305907, a lubricant coating device includes: a brush roller (a lubricant supplying roller) which slides on a photosensitive drum (an image carrier); a solid lubricant which comes into contact with the brush roller; a holding member which holds the solid lubricant; and a compressing spring which biases the solid lubricant and the holding member in the press-contact direction toward the brush roller. Then, the lubricant is gradually scraped off the solid lubricant by the brush roller which rotates in a predetermined direction, and the lubricant which is scraped off and conveyed by the brush roller is coated on (supplied to) the surface of the image carrier. Here, the compressing springs which bias the solid lubricant in the press-contact direction are provided at both end portions of a casing, respectively in the width direction between the casing (the exterior cover) and the holding member which holds the solid lubricant.

In the lubricant supplying device of the related arts, since the compressing springs which are used to bias the solid lubricant in the press-contact direction are attached to the casing in a manner that the compressing springs may not be seen between the holding member and the casing, the compressing springs are attached to the casing in a buckled state or the compressing springs slip off the casing, which easily results in the defective assembly of the compressing springs. Then, when such problems arise, the original function of the lubricant supplying device may not be exhibited.

SUMMARY OF THE INVENTION

It is an object of the present invention to at least partially solve the problems in the conventional technology, by providing a lubricant supplying device, a process cartridge, and an image forming apparatus in which an assembly defect of a compressing spring used to bias a solid lubricant in the press-contact direction scarcely occurs.

In order to solve the aforementioned problems, a lubricant supplying device that supplies a lubricant to an image carrier that carries a toner image according to one aspect of the present invention is constructed in such a manner as to include: a lubricant supplying roller that rotates in a predetermined direction and slides on the image carrier; a solid lubricant that slides on the lubricant supplying roller; a holding member that holds the solid lubricant; a compressing spring with one end being brought into contact with the holding member, thereby biasing the solid lubricant toward the lubricant supplying roller; and a casing that covers the outside of the device, wherein the casing includes an opening portion that allows the other end of the compressing spring, having the one end coming into contact with the holding member, to be exposed therethrough, and a cover member that is installed in the opening portion in a removable manner so that the cover member comes into contact with the other end of the compressing spring and determines a biasing force of the compressing spring.

Further, a process cartridge, which is installed in an image forming apparatus main body so as to be attachable thereto and detachable therefrom, according to another aspect of the present invention is constructed in such a manner as to include the above-mentioned lubricant supplying device and the image carrier.

Still further, an image forming apparatus according to still another aspect of the present invention is constructed in such a manner as to include the above-mentioned lubricant supplying device and the image carrier.

By the way, in the specification of the present application, the term 'process cartridge' is defined as a unit that may be removably installed in the image forming apparatus main body and that is provided with an image carrier integrated with at least one of the charging unit which charges the image carrier, the developing unit (the developing device) which develops the latent image formed on the image carrier, and the cleaning unit which cleans the surface of the image carrier.

Further, in the specification of the present application, the term 'width direction' is defined as a direction which is perpendicular to the direction in which the recording medium is conveyed, and which is the same direction as the main-scanning direction in the image carrier.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiment

Hereinafter, an embodiment of the invention will be described in detail with reference to the drawings. Furthermore, in the respective drawings, the same reference signs are given to the same or equivalent constituents, and the repetitive description thereof will be appropriately simplified or will not be repeated.

First, in FIG. 1, the entire configuration and the entire operation of an image forming apparatus will be described.

Figure 1:
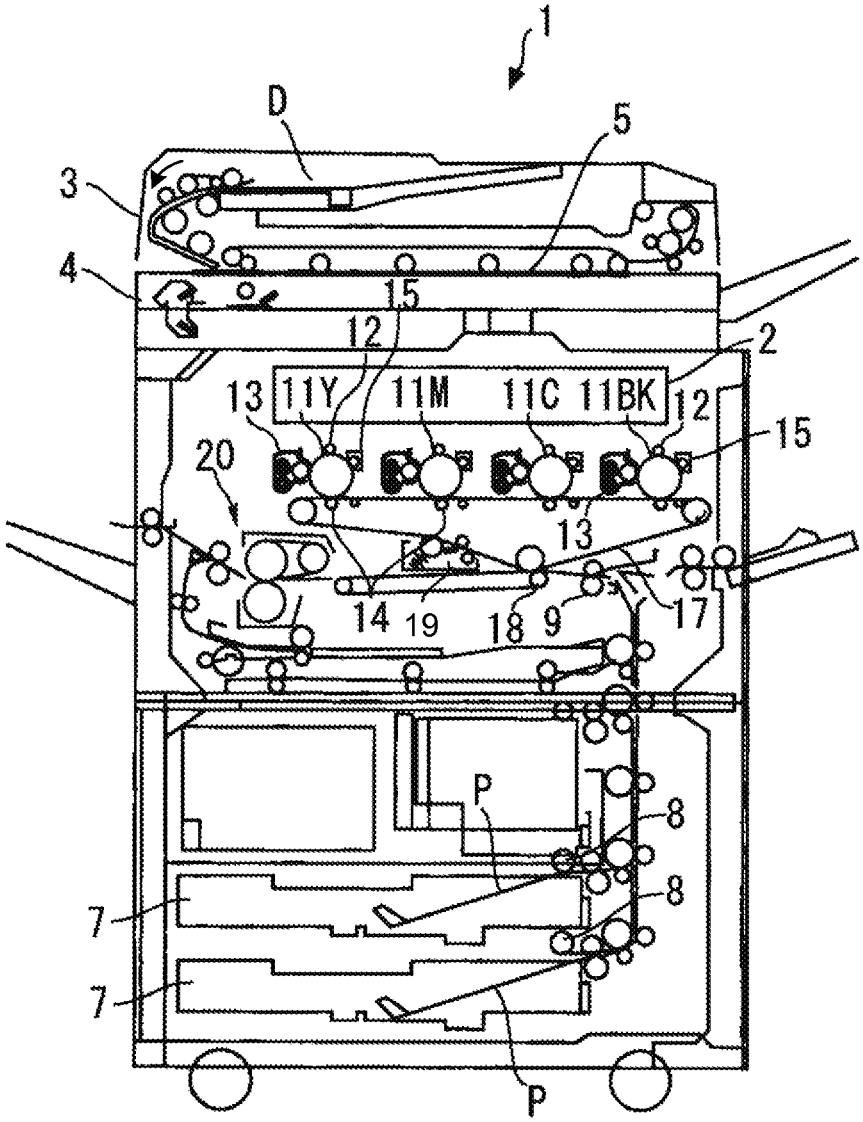
FIG. 1 is an entire configuration diagram illustrating an image forming apparatus according to an embodiment of the invention.

In FIG. 1, an apparatus main body 1 of a tandem type color copying machine which serves as an image forming apparatus is illustrated, wherein reference numeral 2 denotes a writing unit which emits a laser beam based on input image information, numeral 3 denotes a document conveying unit which conveys a document D to a document reading unit 4, 4 denotes a document reading unit which reads the image information of the document D, 7 denotes a paper feeding unit which accommodates a recording medium P such as transfer paper, 9 denotes a registration roller which adjusts the conveying timing of the recording medium P. Further, reference numerals 11Y, 11M, 11C, 11BK denote Photosensitive drums which serve as image carriers for forming respective colors of (yellow, magenta, cyan, and black) toner images thereon, numeral 12 denotes a charging unit which charges the surfaces of the respective photosensitive drums 11Y, 11M, 11C, and 11BK, 13 denotes a developing unit which develops the electrostatic latent images formed on the respective photosensitive drums 11Y, 11M, 11C, and 11BK, 14 denotes a transfer bias roller (a primary transfer bias roller) which transfers the toner images formed on the respective photosensitive drums 11Y, 11M, 11C, and 11BK onto the recording medium P in a state where the toner images are superimposed to each other, 15 denotes a process cartridge, and 15*a* denotes a cleaning unit which collects non-transferred toner on each of the respective photosensitive drums 11Y, 11M, 11C, and 11BK.

Further, reference numeral 17 denotes an intermediate transfer belt to which plural colors of toner images are transferred so that the toner images are superimposed to each other, 18 denotes a secondary transfer bias roller which transfers the color toner image on the intermediate transfer belt 17 onto the recording medium P, 19 denotes an intermediate transfer belt cleaning unit which cleans the intermediate transfer belt 17, and 20 denotes a fixing device which fixes an unfixed image on the recording medium P.

Hereinafter, the general color image forming operation in the image forming apparatus will be described. Furthermore, the image forming process which is performed on the photosensitive drums 11Y, 11M, 11C, and 11BK may be also described by referring to FIG. 2.

First, the document D is conveyed from a platen by a carriage roller of the document conveying unit 3 in the direction depicted by the arrow in the drawing, and is placed on an exposure glass 5 of the document reading unit 4. Then, the image information of the document D which is placed on the exposure glass 5 is optically read in the document reading unit 4.

Specifically, the document reading unit 4 scans the image of the document D on the exposure glass 5 while the image is irradiated by a beam which is emitted from an illuminating lamp. Then, the beam reflected by the document D forms an image on a color sensor through a mirror group and a lens. The color image information of the document D is read for each color separated beam of RGB (red, green, and blue) in the color sensor, and is converted into an electrical image signal. Furthermore, a data processing section performs processes such as a color converting process, a color correcting process, and a spatial frequency correcting process based on the color separation image signals of RGB, and obtains color image information of yellow, magenta, cyan, and black.

Then, the image information items of the respective colors, yellow, magenta, cyan, and black are transmitted to the writing unit 2. Then, laser beams L based on the image information items of the respective colors (see FIG. 2) are respectively irradiated from the writing unit 2 onto the corresponding photosensitive drums 11Y, 11M, 11C, and 11BK.

On the other hand, the four photosensitive drums 11Y, 11M, 11C, and 11BK respectively rotate in the counter-clockwise direction of FIG. 1. Then, first, the surfaces of the photosensitive drums 11Y, 11M, 11C, and 11BK are evenly charged at the portions where the surfaces face the charging units 12 (which is a charging process). In this way, charging potentials are formed on the photosensitive drums 11Y, 11M, 11C, and 11BK. Subsequently, the surfaces of the charged photosensitive drums 11Y, 11M, 11C, and 11BK respectively reach the laser beam irradiating positions.

In the writing unit 2, the laser beams, which correspond to the image signals generated from four light sources, are emitted so as to correspond to the respective colors. The respective laser beams pass through optical paths which are different for the respective color elements of yellow, magenta, cyan, and black (which is an exposure process).

The laser beam which corresponds to the yellow element is irradiated to the surface of the first photosensitive drum 11Y from the left side of the drawing paper. At this time, the laser beam of the yellow element scans the photosensitive drum 11Y in the rotating shaft direction (the main-scanning direction) by a polygon mirror which rotates at a high speed. In this way, the electrostatic latent image which corresponds to the yellow element is formed on the photosensitive drum 11Y which is charged by the charging unit 12.

In the same way, the laser beam which corresponds to the magenta element is irradiated to the surface of the second photosensitive drum 11M from the left side of the drawing paper, so that the electrostatic latent image which corresponds to the magenta element is formed on the surface thereof. The laser beam of the cyan element is irradiated to the surface of the third photosensitive drum 11C from the left side of the drawing paper, so that the electrostatic latent image of the cyan element is formed on the surface thereof. The laser beam of the black element is irradiated to the surface of the fourth photosensitive drum 11BK from the left side of the drawing paper, so that the electrostatic latent image of the black element is formed on the surface thereof.

Subsequently, each of the surfaces of the photosensitive drums 11Y, 11M, 11C, and 11BK having the electrostatic latent images of the respective colors formed thereon reaches a position where the surface faces the developing unit 13. Then, toners of respective colors are supplied from the respective developing units 13 onto the photosensitive drums 11Y, 11M, 11C, and 11BK, so that the latent images formed on the photosensitive drums 11Y, 11M, 11C, and 11BK are developed (which is a developing process).

Subsequently, each of the surfaces of the photosensitive drums 11Y, 11M, 11C, and 11BK subjected to the developing process reaches a position where the surface faces the intermediate transfer belt 17. Here, the transfer bias roller 14 is installed at each facing position so as to come into contact with the inner peripheral surface of the intermediate transfer belt 17. Then, the toner images of the respective colors which are formed on the photosensitive drums 11Y, 11M, 11C, and 11BK are sequentially transferred onto the intermediate transfer belt 17 at the positions of the transfer bias rollers 14 so that the toner images are superimposed to each other (which is a primary transfer process).

Then, each of the surfaces of the photosensitive drums 11Y, 11M, 11C, and 11BK subjected to the primary transfer process reaches a position where the surface faces a cleaning blade 15*a* (a cleaning unit). Then, each cleaning blade 15*a* collects the non-transferred toner which remains on each of the photosensitive drums 11Y, 11M, 11C, and 11BK (which is a cleaning process).

Subsequently, the surfaces of the photosensitive drums 11Y, 11M, 11C, and 11BK pass through a neutralization unit (not illustrated), whereby a series of image forming processes in the photosensitive drums 11Y, 11M, 11C, and 11BK is completed.

On the other hand, the intermediate transfer belt 17 that has the toners of the respective colors transferred from the surfaces of the photosensitive drums 11Y, 11M, 11C, and 11BK so as to be superimposed to each other (to be carried thereon) travels in the clockwise direction in the drawing, so that the intermediate transfer belt reaches a position where it faces the secondary transfer bias roller 18. Then, the color toner image which is carried on the intermediate transfer belt 17 is transferred onto the recording medium P at the position where the intermediate transfer belt faces the secondary transfer bias roller 18 (which is a secondary transfer process).

Subsequently, the surface of the intermediate transfer belt 17 reaches the position of the intermediate transfer belt cleaning unit 19. Then, the non-transferred toner which is attached onto the intermediate transfer belt 17 is collected in the intermediate transfer belt cleaning unit 19, whereby a series of transfer processes in the intermediate transfer belt 17 is completed.

Here, the recording medium P which is conveyed to a gap (which is a secondary transfer nip) between the intermediate transfer belt 17 and the secondary transfer bias roller 18 is conveyed from the paper feeding unit 7 through the registration roller 9 and the like.

Specifically, the recording medium P which is fed by a paper feeding roller 8 from the paper feeding unit 7 accommodating the recording medium P passes through the feed guide, and is guided to the registration roller 9. The recording medium P which reaches the registration roller 9 is conveyed toward the secondary transfer nip at an appropriate timing.

Then, the recording medium P onto which the full color image is transferred is guided by the conveying belt toward the fixing device 20. In the fixing device 20, the color image is fixed onto the recording medium P in the nip between the fixing belt and the pressing roller.

Then, the recording medium P subjected to the fixing process is discharged to the outside of the apparatus main body 1 by a discharging roller as an output image, whereby a series of image forming processes is completed.

Next, referring to FIG. 2, the image forming unit of the image forming apparatus will be described in detail.

Figure 2:
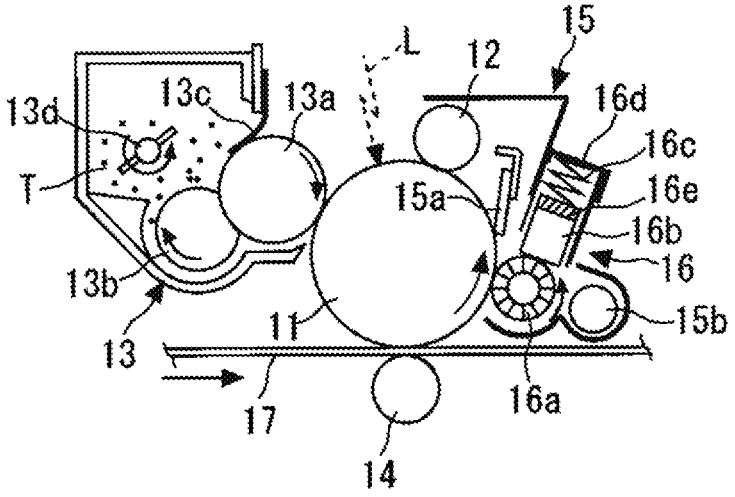
FIG. 2 is a configuration diagram illustrating an image forming unit.

As illustrated in FIG. 2, the image forming unit includes: a photosensitive drum 11 which serves as an image carrier; the charging unit 12 (a roller charging device) which charges the photosensitive drum 11; the developing unit 13 (a developing unit) which develops an electrostatic latent image formed on the photosensitive drum 11; the cleaning blade 15*a* (a cleaning unit) which collects the non-transferred toner on the photosensitive drum 11; a lubricant supplying device 16 (the lubricant supplying unit) which supplies a lubricant onto the photosensitive drum 11; and the like.

Then, in the embodiment, the photosensitive drum 11, the charging unit 12, the cleaning blade 15*a* (the cleaning unit), and the lubricant supplying device 16 which constitute the image forming unit are integrated as a process cartridge 15, and are configured to be removable from the apparatus main body 1 in the form of the process cartridge 15. Further, the developing unit 13 is configured as a unit which is separated from the process cartridge 15 and is removable from the apparatus main body 1.

Furthermore, since the image forming units (or the process cartridges) of the respective colors have substantially the same structure, the image forming units or the process cartridges are illustrated without the reference signs of alphabets (Y, C, M, and BK) in FIGS. 2 to 10.

Here, the photosensitive drum 11 which serves as an image carrier is a negatively charged organic photosensitive drum, and is obtained by forming a photosensitive layer or the like on a drum-like conductive supporting member.

Although not illustrated in the drawings, the photosensitive drum 11 is obtained by sequentially stacking an under coating layer serving as an insulating layer, a charge generating layer and a charge transporting layer serving as photosensitive layers, and a protecting layer (a surface layer) on a conductive support member serving as a base layer.

As the conductive support member (the base layer) of the photosensitive drum 11, a conductive material which has a volume resistance of $10^{10}$ Ωcm or less may be used.

The charging unit 12 (the roller charging device) is a roller member which is obtained by coating an elastic layer having an intermediate resistance on an outer periphery of a conductive core, and is disposed so as to come into contact with the photosensitive drum 11 at the downstream of the rotation direction of the photosensitive drum 11 with respect to the lubricant supplying device 16. Furthermore, the charging unit 12 (the roller charging device) may be disposed so as to face the photosensitive drum 11 without coming into contact therewith.

Then, a predetermined voltage is applied from a power supply (not illustrated) to the charging unit 12, so that the charging unit evenly charges the surface of the photosensitive drum 11 which is disposed to face the charging unit.

The developing unit 13 is disposed so that a developing roller 13*a* comes into contact with the photosensitive drum 11, and a developing field (a developing nip portion) is formed between the both members. A toner T (one-component developer) is accommodated inside the developing unit 13. Then, the developing unit 13 develops the electrostatic latent image which is formed on the photosensitive drum 11 (the toner image is developed).

Specifically, referring to FIG. 2, the developing unit 13 of the embodiment is an one-component developing type developing unit, and includes the developing roller 13*a* (the developer carrier), a supplying roller 13*b*, a doctor blade 13*c* serving as a thinning member, an agitating member 13*d*, and the like.

The developing unit 13 with this configuration is operated as below.

First, a part of the toner which is supplied and accommodated inside the developing unit 13 is carried in the supplying roller 13*b*. The toner which is carried in the supplying roller 13*b* undergoes triboelectric charging at the contact portion against the developing roller 13*a*, and moves onto the developing roller 13*a* so as to be carried thereon. Subsequently, the toner which is carried on the developing roller 13*a* is thinned and equalized at the position of the doctor blade 13*c*, and reaches the contact position (the developing field) against the photosensitive drum 11. Then, at this position, the toner is absorbed to the latent image which is formed on the photosensitive drum 11 by the electric field (developing electric field) formed in the developing field.

Furthermore, in the embodiment, in order to improve the image quality, a spherical toner which has a circularity degree of 0.98 or more is used as the toner T. The 'circularity degree' is an average circularity degree which is measured by a flow particle image analyzer (trade name: FPIA-2000, manufactured by Sysmex Corporation). Specifically, 0.1 to 0.5 mL of a surface acting agent (desirably, alkyl benzene sulfonate) as a dispersing agent is added into 100 to 150 mL of water obtained by removing impure solid materials in a container in advance. Further, 0.1 to 0.5 g of measurement sample (toner) is added. Subsequently, a suspending solution in which the toner is dispersed undergoes dispersion treatment for about 1 to 3 minutes using an ultrasonic dispersing unit so that the concentration of the dispersed solution becomes 3000 to 10000/μL, and the dispersed solution is set in the above-described analyzer. In this state, the shape and the distribution of the toner are measured.

As the spherical toner, a toner which is formed in a spherical shape by performing heat treatment or the like on distorted toners (crushed toner) having different shapes according to a crushing method that has been widely used from the past, a toner which is produced by a polymerization method, and the like may be used.

In the case where this spherical toner is used, in the related art, the toner goes through a small gap formed between the cleaning blade 15*a* and the photosensitive drum 11 and comes out therefrom, which results in a cleaning defect. However, in this embodiment, a lubricant is coated on the surface of the photosensitive drum 11 by the lubricant supplying device 16, so that toner detachability (removable property) on the photosensitive drum 11 is improved. As a result, the occurrence of the cleaning defect is suppressed.

The cleaning blade 15*a* is disposed at the downstream side of the rotation direction of the photosensitive drum 11 with respect to the lubricant supplying device 16. The cleaning blade 15*a* is formed of a rubber material such as urethane rubber, and comes into contact with the surface of the photosensitive drum 11 at a predetermined angle or a predetermined pressure. Accordingly, attachment such as non-transferred toner attached onto the photosensitive drum 11 is mechanically scraped, so that the attachments are collected into the process cartridge 15. Then, the toner which is collected into the process cartridge 15 is conveyed as waste toner by a conveying coil 15*b* toward a waste toner collecting container (not illustrated). Here, as the attachment which is attached onto the photosensitive drum 11, there are paper powders which are produced from the recording medium P (paper), discharge products which are produced on the photosensitive drum 11 at the time of discharging using the roller charging device 12*a*, additives which are added to the toner, and the like, in addition to the non-transferred toner.

Further, the cleaning blade 15*a* of the embodiment also serves as a thinning blade which thins the lubricant which is supplied onto the photosensitive drum 11 by a lubricant supplying roller 16*a*.

The lubricant supplying device 16 includes: a solid lubricant 16*b*; a lubricant supplying roller 16*a* (a brush-like roller) which slides on the photosensitive drum 11 and the solid lubricant 16*b*; a holding member 16*e* which holds the solid lubricant 16*b*; a compressing spring 16*c* (a biasing member) which biases the solid lubricant 16*b* toward the lubricant supplying roller 16*a* together with the holding member 16*e*; and the like.

A lubricant is supplied onto the photosensitive drum 11 by the lubricant supplying device 16 with this configuration. Then, the lubricant which is supplied onto the photosensitive drum 11 is thinned by the cleaning blade 15*a* disposed at the downstream of the lubricant supplying device 16.

Hereinafter, the configuration and the operation of the lubricant supplying device 16 (the lubricant supplying unit) of the embodiment will be described in detail.

As illustrated in FIG. 2, the lubricant supplying device 16 includes: the solid lubricant 16*b*; the lubricant supplying roller 16*a* (the brush-like roller) which slides on the photosensitive drum 11 and the solid lubricant 16*b* and has a brush bristle circumferentially provided thereon; the holding member 16*e* (the holding plate) which holds the solid lubricant 16*b*; the compressing spring 16*c* which biases the solid lubricant 16*b* toward the lubricant supplying roller 16*a* through the holding member 16*e*; and the like.

The lubricant supplying roller 16*a* (the brush-like roller) is obtained in such a manner that brush bristles having a length (a shag) in the range of 0.2 to 20 mm (desirably, 0.5 to 10 mm) and implanted on a ground fabric are wound on a core metal in a spiral shape.

When the length of each of the brush bristles becomes longer than 20 mm, the brush bristles are fallen and tilted in a predetermined direction due to the repeated contact-sliding action thereof against the photosensitive drum 11 with the elapse of time, which results in a problem in which the performance of scraping the solid lubricant 16*b* or the performance of removing the toner from the photosensitive drum 11 is degraded. On the contrary, when the length of each of the brush bristles is less than 0.2 mm, the physical contact force against the solid lubricant 16*b* or the photosensitive drum 11 becomes insufficient. Thus, it is desirable that the length of each of the brush bristles be in the above-described range.

The lubricant supplying roller 16*a* rotates in the counter direction (the counter-clockwise direction of FIG. 2) so as to come into contact with the photosensitive drum 11 which rotates in the counter-clockwise direction of FIG. 2. Further, the lubricant supplying roller 16*a* (the brush bristle) is disposed so as to slide on the solid lubricant 16*b* and the photosensitive drum 11. Accordingly, when the lubricant supplying roller 16*a* rotates, the lubricant supplying roller scrapes the lubricant from the solid lubricant 16*b*, the scraped lubricant is conveyed to a contact position against the photosensitive drum 11, and then the lubricant is coated on the photosensitive drum 11.

The compressing spring 16*c* is disposed in rear of the solid lubricant 16*b* so as to eliminate an uneven contact state between the lubricant supplying roller 16*a* and the solid lubricant 16*b*, and is configured to bias the solid lubricant 16*b* which is held (attached) to the holding member 16*e* toward the lubricant supplying roller 16*a*. Here, one end of the compressing spring 16*c* comes into contact with the holding member 16*e*, and the other end thereof comes into contact with a cover member 16*d* which is installed in a casing 15*c* so as to be attachable thereto and detachable therefrom. However, this will be described in detail later.

In this embodiment, the solid lubricant 16*b* is mainly formed of zinc stearate. Specifically, the solid lubricant 16*b* is obtained by dissolving lubricant additive mainly including zinc stearate, and it is desirable that the solid lubricants have no adverse effect due to over-coating and have a sufficient lubricating property.

The zinc stearate is a typical lamella crystalline powder. The lamella crystalline has a laminated shape in which amphipathic molecules are self-organized, and the crystalline may be easily separated and slid according to the separate layers when a shearing force is applied thereto. Thus, the surface of the photosensitive drum 11 may be made to have low friction. That is, the surface of the photosensitive drum 11 may be effectively covered by a small amount of lubricant due to the lamella crystalline which evenly covers the surface of the photosensitive drum 11 due to the shearing force applied thereto.

Furthermore, as the solid lubricant 16*b*, a lubricant which has a stearate group such as barium stearate, ferric stearate, nickel stearate, cobalt stearate, copper stearate, strontium stearate, and calcium stearate may be used in addition to the zinc stearate. Further, zinc oleate, barium oleate, and lead oleate as the same fatty acid group, a compound similar to stearate hereinafter, zinc palmitic acid, barium palmitic acid, lead palmitic acid, and a compound similar to stearate hereinafter may be used. In addition, as a fatty acid group, caprylic acid, lionlenic acid, corynoline acid, and the like may be used. Furthermore, wax such as candelilla wax, carnauba wax, rice wax, vegetable wax, oba oil, beeswax, or lanolin may be used. These examples may easily become an organic solid lubricant, and has good compatibility with the toner.

When the solid lubricant 16*b* is coated on the surface of the photosensitive drum 11 through the lubricant supplying roller 16*a*, a powder-like lubricant is coated on the surface of the photosensitive drum 11. However, in this state, the lubricating performance is not sufficiently exhibited. For this reason, the cleaning blade 15*a* serves as a thinning blade which equalizes the lubricant. The lubricant is coated on the photosensitive drum 11 by the cleaning blade 15*a*, so that the lubricant may sufficiently exhibit the lubricating performance thereof.

At this time, the powder-like lubricant to be coated by the lubricant supplying roller 16*a* is thinned into the level of a molecule film on the photosensitive drum 11 by the cleaning blade 15*a* as the powder of the lubricant becomes minute.

Hereinafter, referring to FIGS. 3 to 10, the characteristic configuration and the characteristic operation of the lubricant supplying device 16 (the process cartridge 15) of the embodiment will be described.

Figure 3:
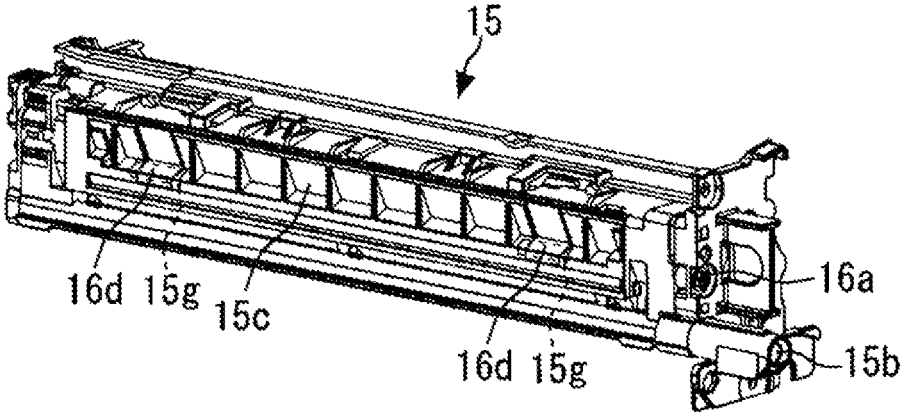
FIG. 3 is a perspective view illustrating a process cartridge.

FIG. 3 is a perspective view illustrating the process cartridge 15 in which the lubricant supplying device 16 is installed. Further, FIG. 4 is a perspective view illustrating a state where one of two cover members 16*d* is attached to and detached from the process cartridge 15 of FIG. 3.

Figure 4:
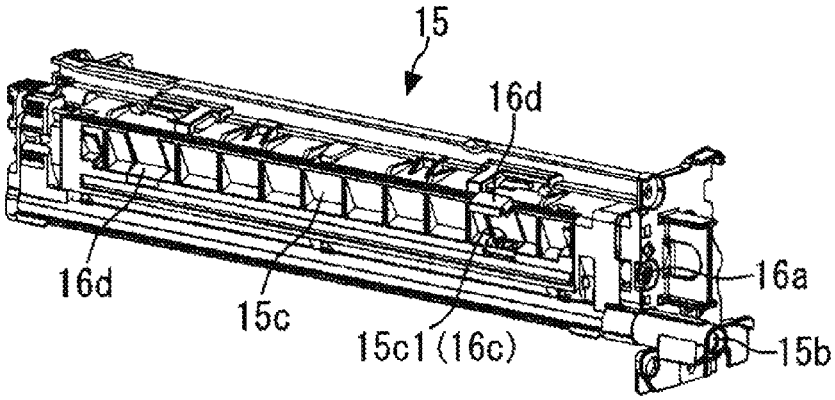
FIG. 4 is a perspective view illustrating a state where a cover member is attached to and detached from the process cartridge of FIG. 3.

Referring to FIGS. 3 and 4, in the casing 15*c* (the exterior cover) configured to cover the outside of the process cartridge 15 (the lubricant supplying device 16), an opening portion 15*c*1 is formed at each of both end portions of the casing 15*c* in the width direction (which is a direction corresponding to the direction perpendicular to the drawing paper of FIG. 2), and the cover member 16*d* is configured to be attached to and detached from the opening portion 15*c*1 by patch-fastening.

Figure 6:
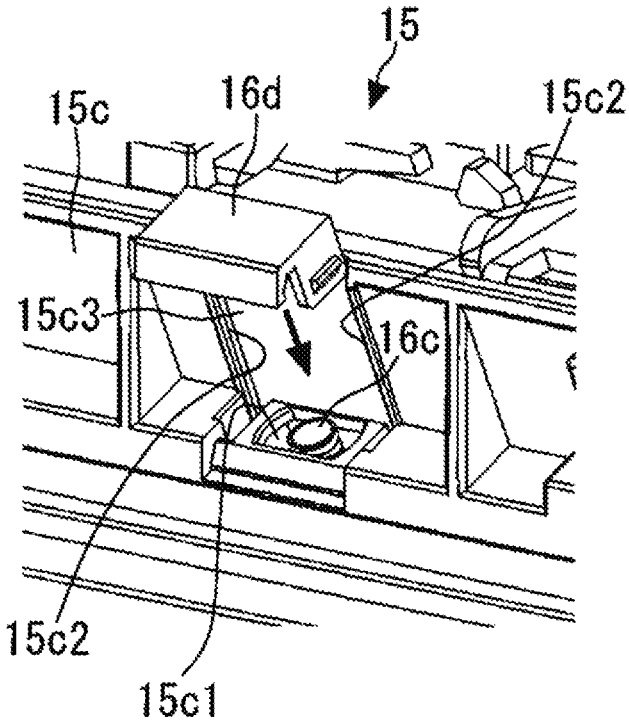
FIG. 6 is an enlarged perspective view illustrating a state where the cover member is set.

Here, referring to FIGS. 4 and 6, the opening portion 15*c*1 of the casing 15*c* allows the other end of the compressing spring 16*c* having one end being in contact with the holding member 16*e* for holding the solid lubricant 16*b* to be exposed therethrough. Then, the cover member 16*d* is attached to the opening portion 15*c*1 so as to come into contact with the other end of the compressing spring 16*c* exposed from the opening portion 15*c*1, and determines the biasing force of the compressing spring. That is, referring to FIG. 7 and the like, when the cover member 16*d* is attached to the casing 15*c* so as to be fitted to the opening portion 15*c*1, the compressing spring 16*c* is set between the cover member 16*d* and the holding member 16*e*, the use length of the compressing spring 16*c* is determined, and the solid lubricant 16*b* is biased toward the lubricant supplying roller 16*a* at a predetermined pressing force together with the holding member 16*e*.

With such a configuration, since the compressing spring 16*c* may be set in a pressurized state while the other end (which is a portion serving as a pressing position) of the compressing spring 16*c* is seen, a problem can be suppressed, in which the compressing spring 16*c* is attached in a buckled state or the compressing spring 16*c* slips off during the assembly process. That is, the assembly workability and the maintenance workability of the compressing spring 16*c* of the process cartridge 15 (the lubricant supplying device 16) may be remarkably improved.

The operation in which the compressing spring 16*c* and the cover member 16*d* are assembled to the process cartridge 15 (the lubricant supplying device 16) may be performed after the other members are completely assembled. That is, in the order illustrated in FIGS. 5 and 6, the compressing spring 16*c* and the cover member 16*d* are sequentially set in the process cartridge 15. Thus, even in the case where the press-contact force of the solid lubricant 16*b* against the lubricant supplying roller 16*a* needs to be changed, the cover member 16*d* may be easily attached and detached and the compressing spring 16*c* having a different spring constant may be simply replaced.

Figure 5:
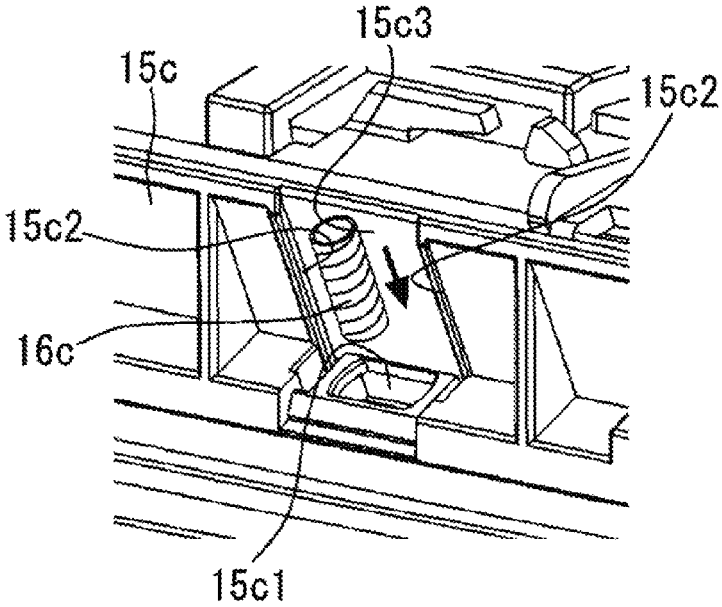
FIG. 5 is an enlarged perspective view illustrating a state where a compressing spring is set.

Specifically, as illustrated in FIG. 5, in the process cartridge 15 (the lubricant supplying device 16) in which the members other than the compressing spring 16*c* and the cover member 16*d* are completely assembled, the compressing spring 16*c* is set inward from the opening portion 15*c*1 of the casing 15*c* (which is the movement in the direction depicted by the arrow of FIG. 5). At this time, referring to FIGS. 7 and 8 and the like, the compressing spring 16*c* is set so that the inner peripheral portion of one end (which is the downside of FIG. 5) of the compressing spring is inserted into a protrusion portion 16*e*1 of the holding member 16*e* and a part of the outer peripheral portion of the one end is covered by an upright portion 16*e*2 of the holding member 16*e*. Furthermore, referring to FIG. 6, in the compressing spring 16*c* of which one end comes into contact with the holding member 16*e*, the outer peripheral portion of the other end (which is the exposure side from the opening portion 15*c*1 in FIG. 6) is covered by the opening portion 15*c*1. The other end of the compressing spring 16*c* in such a state is not fixed and held, but the posture thereof is maintained to a certain extent by the protrusion portion 16*e*1, the upright portion 16*e*2, and the opening portion 15*c*1. For this reason, later, when the cover member 16*d* is set from the upside so as to be fitted to the opening portion 15*c*1 as illustrated in FIG. 6, a positional deviation of the compressing spring 16*c* with respect to the cover member 16*d* scarcely occurs.

Figure 8:
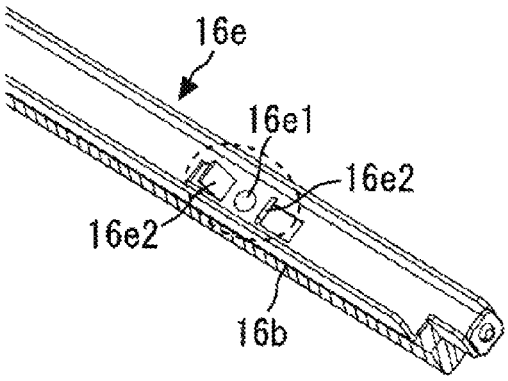
FIG. 8 is a perspective view illustrating a holding member that holds a solid lubricant.

Furthermore, as illustrated in FIG. 8, the holding member 16*e* is formed in a substantially box shape by bending sheet metal, and the protrusion portion 16*e*1 and the upright portion 16*e*2 are respectively formed at both end portions of the holding member in the width direction.

The protrusion portion 16*e*1 of the holding member 16*e* is formed so as to protrude in a semi-spherical shape, and is inserted into the inner peripheral portion of the compressing spring 16*c* as described above. The protrusion portion 16*e*1 is configured to slightly come into contact with (or not to come into contact with) the inner peripheral portion of the compressing spring 16*c* so as not to affect the spring force of the compressing spring 16*c*. Since the protrusion portion 16*e*1 is provided, as illustrated in FIG. 6, the posture of the compressing spring 16*c* which is set from the opening portion 15*c*1 may be stabilized.

Further, the upright portions 16*e*2 of the holding member 16*e* are formed by bending so that the bending angle becomes smaller than 90° at a position where the protrusion portion 16*e*1 is interposed therebetween in the width direction, and are uprightly formed so as to cover the outer peripheral portion of the compressing spring 16*c* in a non-contact state as described above. Since the upright portion 16*e*2 is provided, as illustrated in FIG. 6, the compressing spring 16*c* which is set from the opening portion 15*c*1 may be prevented from being fallen down.

Furthermore, in the embodiment, the bent portion of the holding member 16*e* encircled by the dashed line of FIG. 8 is also a second upright portion which has a function of preventing the compressing spring 16*c* from being fallen down. Further, in the embodiment, a part of the outer peripheral portion of the compressing spring 16*c* is covered in the upright portion 16*e*2 and the second upright portion. However, the entirety (the entire circumference) of the outer peripheral portion of the compressing spring 16*c* may be covered by the upright portion.

Here, in the embodiment, referring to FIGS. 5 and 6, the casing 15*c* is provided with an inclined wall surface 15*c*3 (the wall surface) and a guide portion 15*c*2 which are used to guide the cover member 16*d* to be attached to the opening portion 15*c*1. In other words, a groove portion which guides the cover member 16*d* is formed by the inclined wall surface 15*c*3 and the guide portion 15*c*2.

Specifically, the inclined wall surface 15*c*3 which serves as a wall surface is inclined along the biasing direction of the compressing spring 16*c*. Then, as illustrated in FIG. 6, the cover member 16*d* is smoothly attached to a position where it blocks the opening portion 15*c*1 in such a manner that the cover member 16*d* is slid in the direction depicted by the arrow along the inclined surface 15*c*3 while the end surface of the cover member 16*d* comes into contact with the inclined surface 15*c*3. Furthermore, since the inclined wall surface 15*c*3 is inclined in parallel to the biasing direction of the compressing spring 16*c*, the cover member 16*d* which is attached along the inclined wall surface 15*c*3 comes into contact with the tensile spring 16*c* in the direction parallel to the biasing direction, so that the tensile spring 16*c* scarcely falls down due to the attachment of the cover member 16*d*.

Further, the guide portions 15*c*2 are uprightly formed at both end portions of the inclined wall surface 15*c*3 in the width direction, and are used to guide both end portions of the cover member 16*d* in the width direction. Then, as illustrated in FIG. 6, the cover member 16*d* is smoothly attached to a position where it blocks the opening portion 15*c*1 in such a manner that the cover member 16*d* is slid in the direction depicted by the arrow while the cover member 16*d* is gripped so as to be interposed between the guide portions 15*c*2.

Figure 7:
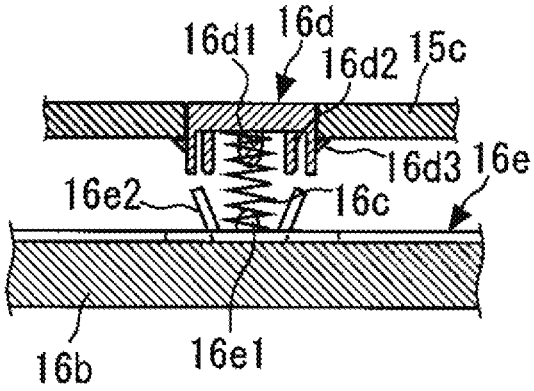
FIG. 7 is a cross-sectional view illustrating a state where the compressing spring and the cover member are set.

Then, referring to FIG. 7, in the cover member 16*d*, claw portions 16*d*3 and an eave portion 16*d*4 are respectively locked (patch-fastened) to the casing 15*c* through the engagement with the engagement portion of the casing 15*c* in the state where a boss portion 16*d*1 is loosely inserted into the inner peripheral portion of the other end of the compressing spring 16*c* and wall portions 16*d*2 cover the outer peripheral portion of the other end of the compressing spring 16*c*.

Figure 9:
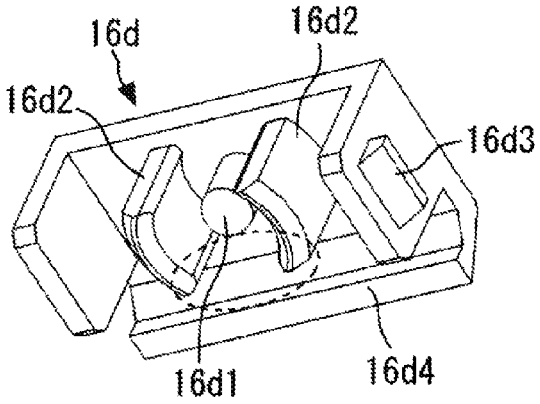
FIG. 9 is a perspective view illustrating the cover member.
Figure 10:
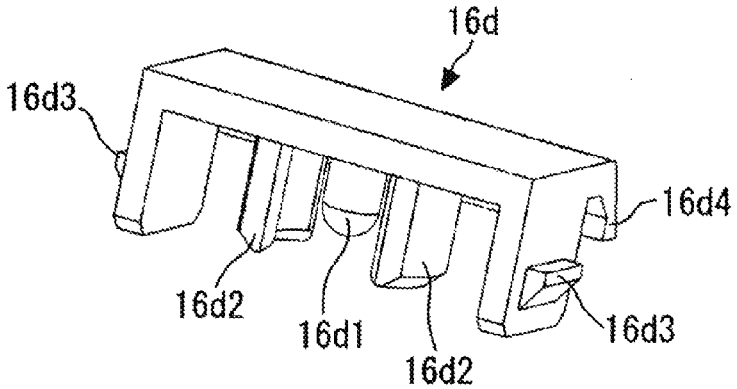
FIG. 10 is another perspective view illustrating the cover member.

Specifically, referring to FIGS. 9 and 10, the cover member 16*d* is provided with the boss portion 16*d*1, the wall portions 16*d*2, the claw portions 16*d*3, the eave portion 16*d*4, and the like.

The boss portion 16*d*1 of the cover member 16*d* is a substantially columnar member of which the front end is formed in a semi-spherical shape, and is inserted in the compressing spring 16*c* having a gap from the inner peripheral portion of the compressing spring. Since the boss portion 16*d*1 is provided, as illustrated in FIG. 7, the posture of the compressing spring 16*c* which is set between the cover member 16*d* and the holding member 15*e* may be stabilized.

Further, the wall portions 16*d*2 of the cover member 16*d* are respectively formed at the position where the boss portion 16*d*1 is interposed therebetween in the width direction so as to have a circular-arc shape, and are uprightly formed so as to cover a part of the outer peripheral portion of the compressing spring 16*c* in a non-contact state. Since the wall portions 16*d*2 are provided, as illustrated in FIG. 7, the compressing spring 16*c* which is set between the cover member 16*d* and the holding member 15*e* may be prevented from being fallen down.

Furthermore, in the embodiment, a part of the outer peripheral portion of the compressing spring 16*c* is covered by the wall portions 16*d*2, but the wall portions 16*d*2 may be formed so as to cover the entirety (the entire circumference) of the outer peripheral portion of the compressing spring 16*c*.

Furthermore, the claw portions 16*d*3 of the cover member 16*d* are formed so as to protrude from the arm portions of both end portions of the cover member 16*d* in the width direction as illustrated in FIGS. 9 and 10. Then, at the time when the cover member 16*d* is attached to the opening portion 15*c*1, the arm portions are elastically deformed due to the external force applied thereto so as to avoid the interference with the edge portion of the opening portion 15*c*1. Then, when the external force is eliminated later, the elastically deformed arm portion is restored, so that the claw portions 16*d*3 engage with the engagement portions of the opening portion 15*c*1 (which is the state of FIG. 7). Accordingly, the cover member 16*d* engages with the casing 15*c* (the opening portion 15*c*1), so that the cover member 16*d* does not easily slip off the casing 15*c*.

Further, the eave portion 16*d*4 of the cover member 16*d* is formed at a position where it does not face the inclined wall surface 15*c*3 in the cover member 16*d* as illustrated in FIGS. 9 and 10, and the front end is provided with a claw-like subject engagement portion. Then, at the time when the cover member 16*d* is attached to the opening portion 15*c*1, the eave portions 16*d*4 are elastically deformed due to the external force applied thereto so as to avoid the interference with the edge portion of the opening portion 15*c*1. Then, when the external force is eliminated, the elastically deformed eave portion 16*d*4 is restored, so that the subject engagement portion engages with the engagement portion of the opening portion 15*c*1 (which is the state of FIG. 3). Accordingly, the cover member 16*d* engages with the casing 15*c* (the opening portion 15*c*1), so that the cover member 16*d* does not easily slip off the casing 15*c*.

Here, in the embodiment, the wall portion 16*d*2 of the cover member 16*d* is provided with a notch portion (which is a portion encircled by the dashed line of FIG. 9) which is formed so as not to face the inclined wall surface 15*c*3 of the casing 15*c* when the cover member is attached to the opening portion 15*c*1 of the casing 15*c*. That is, the wall portion 16*d*2 is not formed in a columnar shape, but a notch portion is formed therein so as to face a worker who attaches the cover member 16*d* to the opening portion 15*c*1.

With such a configuration, the worker who attaches the cover member 16*d* to the opening portion 15*c*1 may completely set the cover member 16*d* while observing the compressing spring 16*c* exposed from the opening portion 15*c*1 through the notch portion. For this reason, the assembly defect of the compressing spring 16*c* may be more reliably suppressed.

Here, in the embodiment, referring to FIG. 3, the cover member 16*d* which is installed in the opening portion 15*c*1 and a seal material 15*g* which covers the periphery thereof from outside are attached to the casing 15*c*. That is, first, as described above by referring to FIGS. 5 and 6 and the like, when the compressing spring 16*c* and the cover member 16*d* are completely set in the opening portion 15*c*1, the seal material 15*g* is attached onto the casing 15*c* so as to cover the cover member 16*d* and the periphery thereof from outside.

The seal material 15*g* is formed of a flexible material such as Mylar having a thickness of 0.1 mm or less, and the attachment surface against the casing 15*c* is provided with a double-faced tape. Then, the seal material adheres to the casing 15*c* and the cover member 16*d* so as to seal the gap (the boundary) between the cover member 16*d* and the casing 15*c* (the opening portion 15*c*1).

With such a configuration, a problem may be suppressed in which the toner inside the process cartridge 15 leaks to the outside from the gap between the cover member 16*d* and the casing 15*c* (the opening portion 15*c*1). Furthermore, the cover member 16*d* is more strongly fixed to the casing 15*c*.

As described above, according to the embodiment, the casing 15*c* is provided with the opening portion 15*c*1 which allows the other end of the compressing spring 16*c* having one end being in contact with the holding member 16*e* to be exposed therethrough, and the cover member 16*d* is provided which is installed in the opening portion 15*c*1 so as to be attachable thereto and detachable therefrom so that the cover member comes into contact with the other end of the compressing spring 16*c*. Accordingly, the assembly defect of the compressing spring 16*c* may be prevented which is used to bias the solid lubricant 16*b* in the press-contact direction.

Furthermore, in the embodiment, the photosensitive drum 11, the charging unit 12, the cleaning blade 15*a* (the cleaning unit), and the lubricant supplying device 16 of the image forming unit are integrated with each other so as to configure the process cartridge 15, so that the image forming unit may be decreased in size and the maintenance workability thereof is improved.

On the contrary, the developing unit 13 may also constitute the process cartridge 15. Furthermore, the respective members 11, 12, 13, 15*a*, and 16 of the image forming unit may not be provided as members constituting the process cartridge, and may be installed in the apparatus main body 1 so as to be separately replaceable. Even in this case, the same effect as that of the embodiment may be obtained.

Further, in the embodiment, the invention is applied to the image forming apparatus on which the one-component developing type developing unit 13 using one-component developer is mounted. However, the invention may be, of course, applied to an image forming apparatus on which a two-component developing type developing unit 13 using two-component developer is mounted.

Further, in the embodiment, the invention is applied to the tandem type color image forming apparatus which uses the intermediate transfer belt 17. On the contrary, the invention may be applied to other image forming apparatuses such as a tandem type color image forming apparatus using a transfer conveying belt (which is an apparatus in which toner images on plural photosensitive drums arranged to face a transfer conveying belt are transferred onto a recording medium conveyed by a transfer conveying belt so that the toner images are superimposed to each other) or a monochrome image forming apparatus. Then, even in this case, the same effect as that of the embodiment may be obtained.

Further, in the embodiment, the invention is applied to the lubricant supplying device 16 which supplies the lubricant onto the photosensitive drum 11 serving as the image carrier. However, the invention may be, of course, applied to a lubricant supplying device which supplies a lubricant to an image carrier other than the photosensitive drum 11 (for example, a lubricant supplying device which supplies a lubricant onto the intermediate transfer belt 17). Then, even in this case, since the cover member 16*d* is provided which is installed in the opening portion 15*c*1 so as to be attachable thereto and detachable therefrom so that the cover member comes into contact with the other end of the compressing spring 16*c* as in the embodiment, the same effect as that of the embodiment may be obtained.

Further, in the embodiment, the brush-like roller having brush bristles circumferentially provided thereon is used as the lubricant supplying roller 16*a*. However, a sponge-like roller having a sponge-like member (an elastic material) circumferentially provided thereon may be used as the lubricant supplying roller 16*a*. Then, even in this case, since the cover member 16*d* is provided which is installed in the opening portion 15*c*1 so as to be attachable thereto and detachable therefrom so that the cover member comes into contact with the other end of the compressing spring 16*c* as in the embodiment, the same effect as that of the embodiment may be obtained.

In the invention, the casing is provided with the opening portion which allows the other end of the compressing spring, having one end being in contact with the holding member, to be exposed therethrough, and the casing is further provided with the cover member which is installed in the opening portion in a manner of being removable from the opening portion so that the cover member comes into contact with the other end of the compressing spring. Accordingly, the invention provides the lubricant supplying device, the process cartridge, and the image forming apparatus in which the assembly defect of the compressing spring used to bias the solid lubricant in the press-contact direction scarcely occurs.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A lubricant supplying device that supplies a lubricant to an image carrier that carries a toner image, the lubricant supplying device comprising:

a lubricant supplying roller that rotates in a predetermined direction and slides on the image carrier;

a solid lubricant that slides on the lubricant supplying roller;

a holding member that holds the solid lubricant;

a compressing spring with one end being brought into contact with the holding member, thereby biasing the solid lubricant toward the lubricant supplying roller; and a casing that covers the outside of the device, wherein the casing includes an opening portion that allows the other end of the compressing spring, having the one end coming into contact with the holding member, to be exposed therethrough, a cover member that is installed in the opening portion in a removable manner so that the cover member comes into contact with the other end of the compressing spring and determines a biasing force of the compressing spring; and a wall portion that is uprightly formed so as to cover a part or an entirety of an outer peripheral portion of the compressing spring, and are uprightly formed so as to cover a part of the outer peripheral portion of the compressing spring in a non-contact state, wherein a notch portion is formed in the wall portion of the cover member so as not to face a wall surface of the casing when the cover member is attached to the opening portion of the casing.

2. The lubricant supplying device according to claim 1, wherein the cover member includes a boss portion loosely inserted into an inner peripheral portion of the compressing spring.

3. The lubricant supplying device according to claim 1, wherein the holding member includes a protrusion portion that is inserted into the inner peripheral portion of the compressing spring, and an upright portion that is uprightly formed in a longitudinal direction of the holding member so as to cover a part or an entirety of the outer peripheral portion of the compressing spring.

4. The lubricant supplying device according to claim 1, wherein the casing includes a wall surface that is inclined along a biasing direction of the compressing spring so as to guide the cover member attached to the opening portion, and a guide portion that guides both end portions of the cover member in the width direction so as to guide the cover member attached to the opening portion.

5. The lubricant supplying device according to claim 1, wherein the opening portion of the casing is formed so as to cover the outer peripheral portion of the compressing spring having one end coming into contact with the holding member.

6. The lubricant supplying device according to claim 1, further comprising a seal material attached to the casing that covers the cover member installed in the opening portion of the cover member from the outside.

7. A process cartridge that is installed in an image forming apparatus main body so as to be attachable thereto and detachable therefrom, the process cartridge comprising a lubricant supplying device and an image carrier;

wherein the lubricant supplying device comprises:

a lubricant supplying roller that rotates in a predetermined direction and slides on the image carrier;

a solid lubricant that slides on the lubricant supplying roller;

a holding member that holds the solid lubricant;

a compressing spring with one end being brought into contact with the holding member, thereby biasing the solid lubricant toward the lubricant supplying roller; and a casing that covers the outside of the device, wherein the casing includes an opening portion that allows the other end of the compressing spring, having the one end coming into contact with the holding member, to be exposed therethrough, a cover member that is installed in the opening portion in a removable manner so that the cover member comes into contact with the other end of the compressing spring and determines a biasing force of the compressing spring; and a wall portion that is uprightly formed so as to cover a part or an entirety of an outer peripheral portion of the compressing spring, and are uprightly formed so as to cover a part of the outer peripheral portion of the compressing spring in a non-contact state, wherein a notch portion is formed in the wall portion of the cover member so as not to face a wall surface of the casing when the cover member is attached to the opening portion of the casing.

8. The process cartridge according to claim 7, further comprising:

a cleaning blade that is installed on the downstream side with respect to the lubricant supplying device in a rotation direction of the image carrier so as to clean a surface of the image carrier.

9. An image forming apparatus comprising:

a lubricant supplying device and an image carrier, wherein the lubricant supplying device comprises:

a lubricant supplying roller that rotates in a predetermined direction and slides on the image carrier;

a solid lubricant that slides on the lubricant supplying roller;

a holding member that holds the solid lubricant;

a compressing spring with one end being brought into contact with the holding member, thereby biasing the solid lubricant toward the lubricant supplying roller; and a casing that covers the outside of the device, wherein the casing includes an opening portion that allows the other end of the compressing spring, having the one end coming into contact with the holding member, to be exposed therethrough, a cover member that is installed in the opening portion in a removable manner so that the cover member comes into contact with the other end of the compressing spring and determines a biasing force of the compressing spring; and a wall portion that is uprightly formed so as to cover a part or an entirety of an outer peripheral portion of the compressing spring, and are uprightly formed so as to cover a part of the outer peripheral portion of the compressing spring in a non-contact state, wherein a notch portion is formed in the wall portion of the cover member so as not to face a wall surface of the casing when the cover member is attached to the opening portion of the casing.

10. The lubricant supplying device according to claim 1, wherein the cover member includes parallel sides and an eave portion between the parallel sides and facing away from the wall portion of the wall surface casing, the parallel sides extending from a top of the cover further than the eave portion.

11. The process cartridge according to claim 7, wherein the cover member includes parallel sides and an eave portion between the parallel sides and facing away from the wall portion of the wall surface casing, the parallel sides extending from a top of the cover further than the eave portion.

12. The image forming apparatus according to claim 9, wherein the cover member includes parallel sides and an eave portion between the parallel sides and facing away from the wall portion of the wall surface casing, the parallel sides extending from a top of the cover further than the eave portion.

* * * * *